US006679785B1

(12) United States Patent
Richard

(10) Patent No.: US 6,679,785 B1
(45) Date of Patent: Jan. 20, 2004

(54) GOLF PUTTER

(76) Inventor: Phelan Richard, 1913 Westleigh Dr., Glenview, IL (US) 60025

( * ) Notice: Subject to any disclaimer, the term of this patent is extended or adjusted under 35 U.S.C. 154(b) by 0 days.

(21) Appl. No.: 10/238,998

(22) Filed: Sep. 10, 2002

(51) Int. Cl.[7] ..... A63B 53/14
(52) U.S. Cl. ..... 473/296; 473/298; 473/299
(58) Field of Search ..... 473/300, 301, 473/302, 303, 296, 239, 298, 299, 307, 282, 318

(56) References Cited

U.S. PATENT DOCUMENTS 4,340,227 A * 7/1982 Dopkowski ..... 473/288
5,154,327 A * 10/1992 Long ..... 222/326
5,513,845 A * 5/1996 Sonagere ..... 473/206
5,569,096 A * 10/1996 Lee ..... 473/248
6,241,623 B1 * 6/2001 Laibangyang ..... 473/232
6,394,909 B1 * 5/2002 Laibangyang ..... 473/232

* cited by examiner

*Primary Examiner*—Stephen Blau
(74) *Attorney, Agent, or Firm*—Edward D. Gilhooly

(57) ABSTRACT

A novelty golf putter including a hollow shaft, a putter head affixed to one end of the hollow shaft and a gripping handle affixed to an opposite end portion of the hollow shaft. An elongated line being affixed with the hollow shaft and within the gripping handle. The gripping handle is moveable from the hollow shaft to extend the distance of the handle from the end of the shaft.

3 Claims, 1 Drawing Sheet

GOLF PUTTER

BACKGROUND OF THE INVENTION

1. Field of the Invention

This invention relates to the game of golf and more particularly, to a novelty golf club.

2. Summary of the Prior Art

In golf, it is the well known objective of the game to move a golf ball from a starting point (the tee) to a finishing point (the hole) in the fewest strokes possible over a course having a number of holes, such as nine or eighteen. The hole is generally positioned at an arbitrary location on a smooth area of grass or green. An appropriate golf club known as a putter is normally used on the green to move the ball into the hole. It is a common courtesy during a golf game for an opposing player(s) to concede a putt without putting it in the hole, if a ball is sufficiently close. One arbitrary gauge of conceding a putt occurs when the distance between the ball lying on the green and the hole is within "the leather" or the length of the putter handle.

SUMMARY OF THE INVENTION

It is an objective of the invention to provide a novelty putter which may function as a normal putter, but also is capable of being a novelty club by which the concept of being within the leather for concession of a putt is extended to the advantage of the player putting. The handle of a putter herein is normally secured in a conventional manner to the club shaft. The handle is also removable from the shaft and remains in retention to the shaft through an elongated line or strap to extend the length of the handle area with respect to the club shaft and thus extend the distance from the hole at which a putt is conceded.

DESCRIPTION OF THE PREFERRED EMBODIMENT

Figure 1:
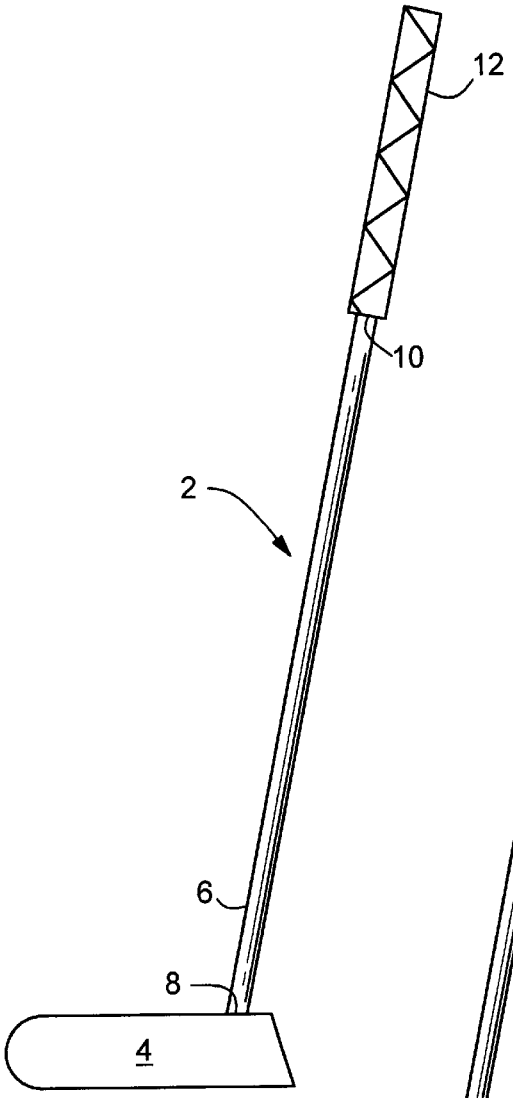
FIG. 1 is a side elevational view of a first embodiment of the novelty golf putter of the invention.
Figure 2:
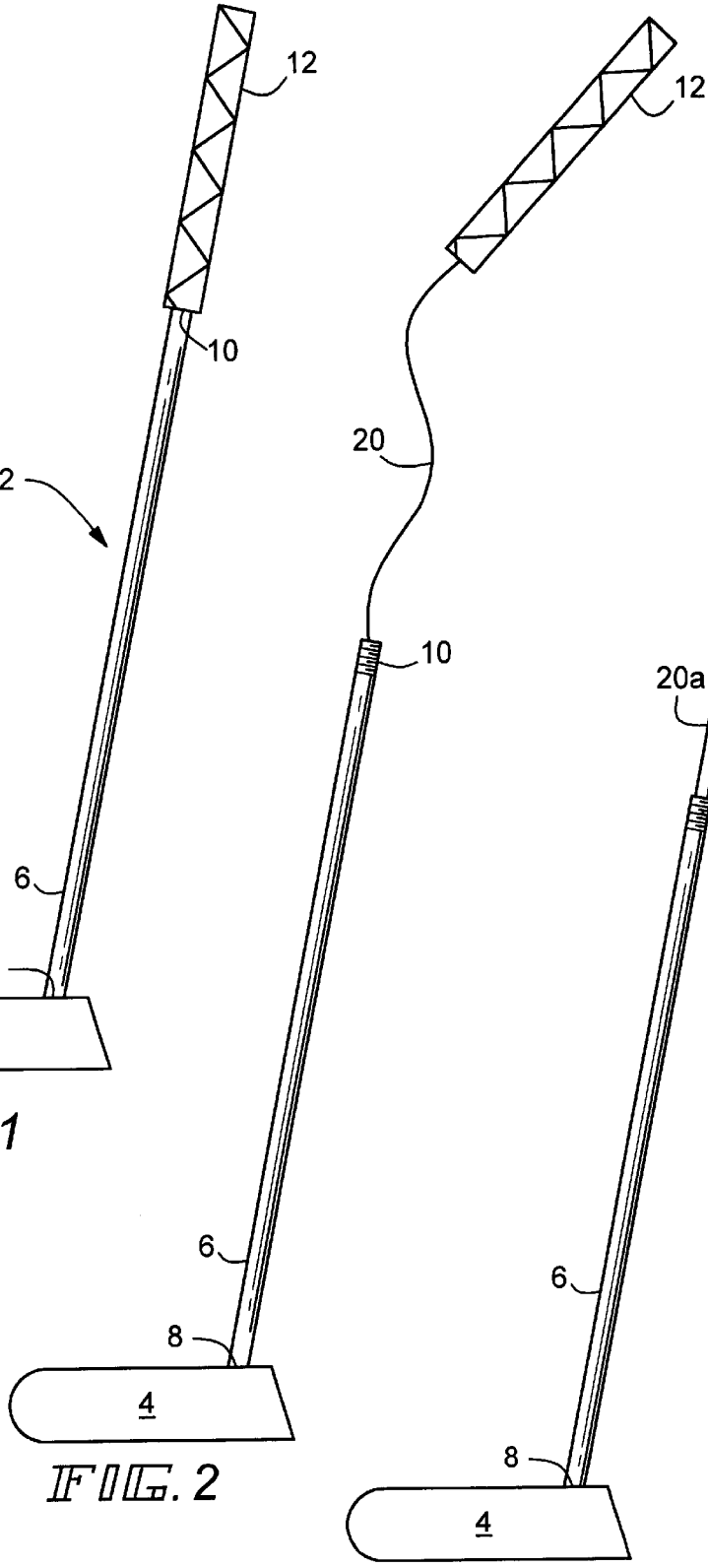
FIG. 2 is a side elevational view of the novelty golf putter of FIG. 1 with its handle removed.

Referring now to the drawings, there is illustrated the novelty golf putter of the invention, generally designated by reference numeral 2. The putter 2 includes a typical metal club head 4 and an elongated hollow shaft 6 formed from metal or other suitable material. The bottom end 8 of the hollow shaft 6 is suitably affixed in a hole (not shown) within the top of the metal removable club head 4. The upper end portion 10 of the shaft 6 is affixed to a hollow cylindrical handle 12 by external threads on shaft 6 and internal threads (not shown) provided at an internal position within the open bottom end of handle 12. The handle 12 creates an upper gripping area formed of a leather or rubber material suitably wrapped around the shaft 6. The end of shaft 6 may extend partially or substantially into the handle 12 dependent on the position of the internal threads (not shown) of the handle 12. Alternatively, the hollow cylindrical handle 12 may be affixed to the shaft 6 by detents or other locking elements (not shown) that lock the handle 12 on the shaft 6 for normal play and allow removal of the handle 12 to extend the length of the handle within the contemplation of the invention. An elongated line or strap 20 (FIG. 2) formed from a plastic line, leather strap, wire and the like is suitably affixed within the handle 12 at one end portion (not shown) and within the hollow shaft 6 at the opposite end portion of the line or strap 20 (not shown) to secure the shaft 6 to the handle 12 when the handle is removed as in FIG. 2. The line or strap 20 is stowed within the shaft 6 when the handle 12 is in its secured portion of FIG. 1. During play, the player using putter 2 may at his or her option claim that the ball is within the leather by removing handle 12 and stretching the line 20 to greatly increase the distance from the hole at which a putt is conceded.

Figure 3:
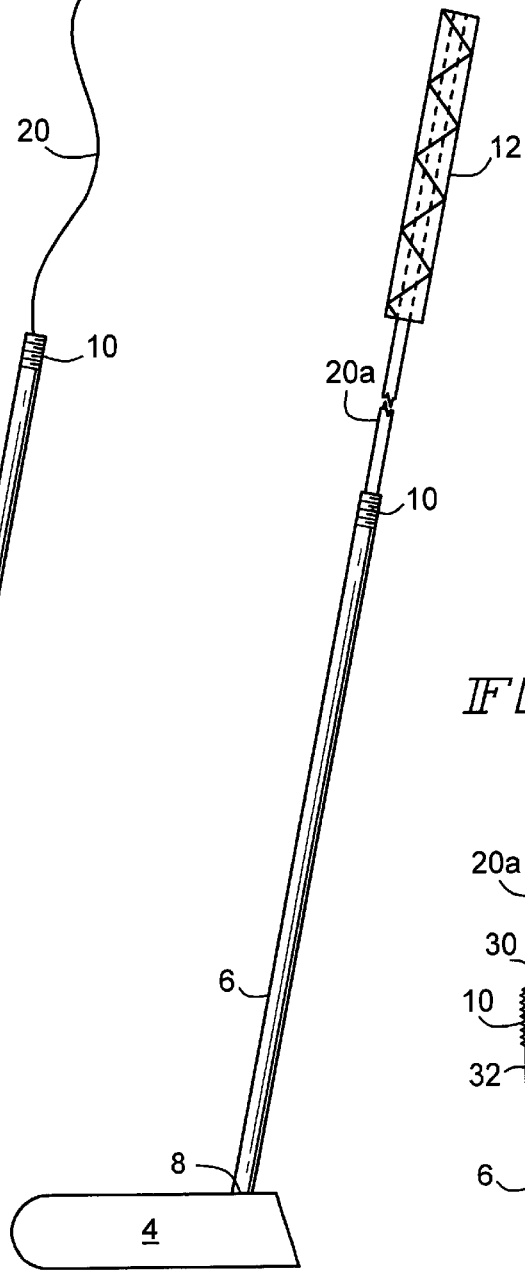
FIG. 3 is a side elevational view of a second embodiment of the novelty golf putter of the invention.
Figure 4:
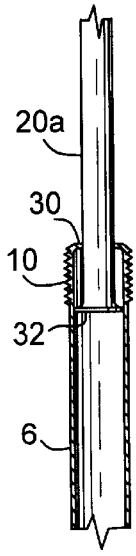
FIG. 4 is a partial side view, with parts removed, of the shaft and inner rod of the novelty golf putter of FIG. 3.

Referring now to FIGS. 3 and 4, there is illustrated a second embodiment of the novelty golf putter of the invention; generally designated by reference numeral 2. The putter 2 includes a putter head 4; and a hollow shaft 6 attached to the putter head 4 in hole 8. A handle 12 having complimentary internal threads (not shown) is attached to the threads 10 of shaft 6 for normal putting. A rod 20*a* is telescopically mounted within shaft 6 in stowed relationship in attachment to handle 12 by screws and the like (not shown) to allow the handle 12 to be extended outward relative to shaft 6 in accordance with the invention. To prevent detachment of the handle 12 from the shaft 6; the lower end of shaft 6 includes an enlarged end 32 to engage the shoulder 30 to prevent further movement of the rod 20*a*. The handle 12 is unscrewed from the shaft 6 to permit extension of the rod 20*a* and handle 12. After being extended, the rod 20*a* can be reinserted into the shaft 6 and the handle can be reattached to threads 10.

What is claimed is:

1. A golf putter comprising an elongated hollow shaft having opposite ends, handle means being removably affixed to one of said opposite ends, a putter head affixed to a second one of said opposite ends, strap means having a first end portion secured to said elongated hollow shaft, said strap means having a second end affixed to said handle, said strap means being stowed within said hollow shaft while said handle means is affixed to said hollow shaft, and said strap means permitting said handle means to be extended from said one of said opposite ends of said hollow shaft is in connected relationship to both said hollow shaft and said handle means upon removal of said handle means from said hollow shaft.

2. The golf putter according to claim 1 further including thread means for affixing said handle means to said hollow shaft.

3. The golf putter according to claim 2 wherein said strap means is an elongated line.

* * * * *